United States Patent [19]

Nishioka

[11] 4,446,844

[45] May 8, 1984

[54] PROJECTILE SHOOTING GUIDE FOR BOWS

[76] Inventor: Jim Z. Nishioka, 1268 Hemlock NW., Salem, Oreg. 97304

[21] Appl. No.: 392,547

[22] Filed: Jun. 28, 1982

[51] Int. Cl.[3] ..... F41B 5/00

[52] U.S. Cl. ..... 124/41 A; 124/24 R

[58] Field of Search ..... 124/24 R, 88, 90, 86, 124/41 A

[56] References Cited

U.S. PATENT DOCUMENTS

| | | | |
|---|---|---|---|
| 85,874 | 1/1869 | Tilden | 124/24 R |
| 1,725,760 | 8/1929 | Ikeda | 124/24 R |
| 2,125,591 | 8/1938 | Smith | 124/24 R |
| 4,291,664 | 9/1981 | Nishioka | 124/41 A |

*Primary Examiner*—Richard J. Apley
*Assistant Examiner*—William R. Browne

[57] ABSTRACT

An elongated guide member is mounted on a bow by a support and in its mounted position the guide member extends towards the bowstring. In a first form of the disclosure the guide member is slidably supported by the support. A resilient tube is positioned on the shooting guide and is connected to the rearward portion of the guide member so that when the rearward portion is drawn rearwardly and then released the tube will urge the rearward portion in a forward direction towards its pre-draw position. In a second form of the disclosure a resilient tube forms a part of the guide member.

8 Claims, 8 Drawing Figures

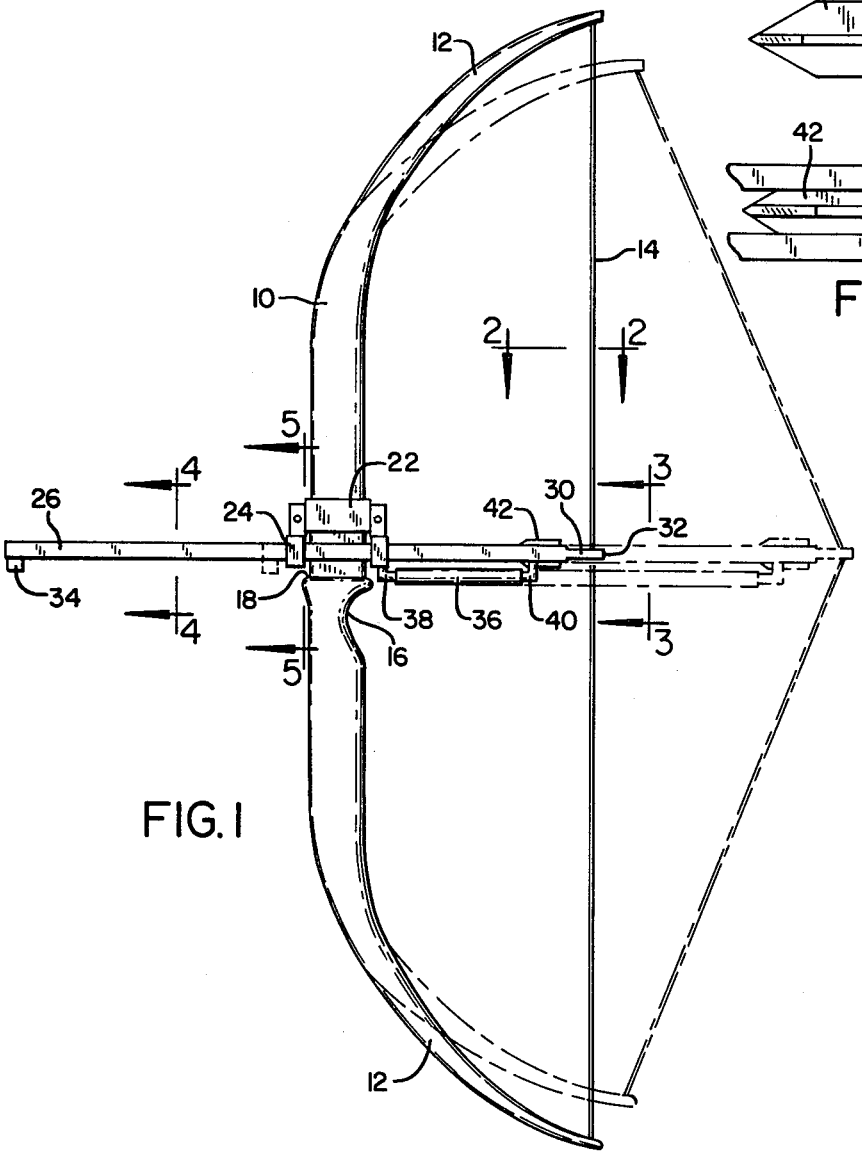
FIG. 1
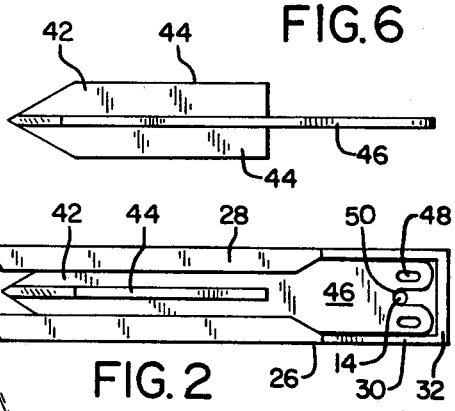
FIG. 2
FIG. 6
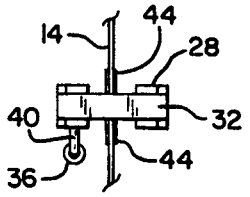
FIG. 3
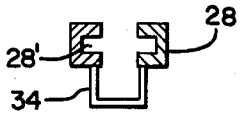
FIG. 4
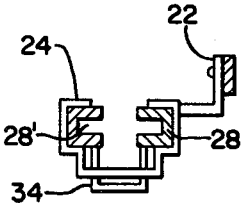
FIG. 5
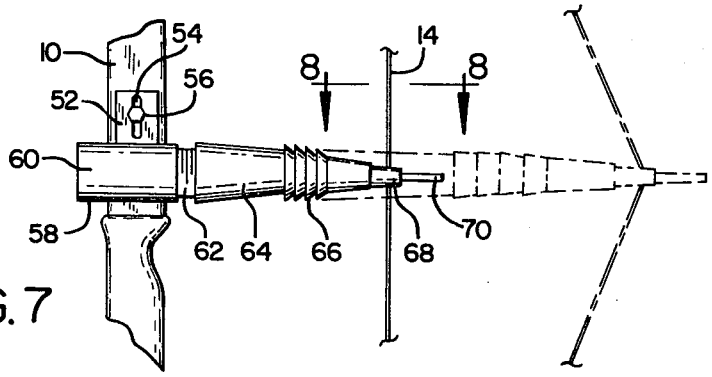
FIG. 7
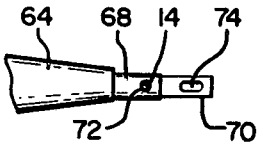
FIG. 8

PROJECTILE SHOOTING GUIDE FOR BOWS

FIELD OF THE INVENTION

This invention relates to new and useful improvements in projectile shooting guides for bows.

SUMMARY OF THE INVENTION

According to the present invention and forming primary objectives thereof, a projectile shooting guide for bows is provided having a novel structural arrangement of a guide member and a projectile. Resilient means are also provided to cause the rearward portion of the guide member to move forwardly when the guide is shot.

In carrying out the invention, an elongated guide member is mounted on a support attachable to a bow, and such guide member includes guide means therein for guiding a projectile to be shot by the bowstring. A structural combination is provided in one embodiment which causes a forward sliding movement of the guide member when the shooting guide is shot. The structural combination of another embodiment of the invention employs a resilient means which comprises a tube which forms a portion of the guide member and also urges the rearward portion forwardly when the shooting guide is shot.

The use of a resilient means is desirable to provide a projectile shooting guide which automatically assumes a pre-draw position after it is shot. The pre-draw profile of the guide makes it much easier to handle and store. A further advantage is that when the guide is shot the resilient means urges the guide member away from the shooter's face.

A projectile with an aperture in its tail section for receiving a draw force is also provided.

The invention will be better understood and additional objects and advantages will become apparent from the following description taken in connection with the accompanying drawings.

BRIEF DESCRIPTION OF THE DRAWINGS

FIG. 1 is a side elevational view of a bow and a first form of shooting guide embodying principles of the present invention;

FIG. 2 is a fragmentary enlarged top plan view of a guide member taken on lines 2—2 of FIG. 1;

FIG. 3 is a fragmentary enlarged view of a guide member taken on lines 3—3 of FIG. 1;

FIG. 4 is an enlarged sectional view of a guide member taken on lines 4—4 of FIG. 1;

FIG. 5 is an enlarged sectional view of a guide member taken on lines 5—5 of FIG. 1;

FIG. 6 is an enlarged side elevational view of a projectile;

FIG. 7 is a side elevational view of a second form of a shooting guide embodying principles of the present invention; and FIG. 8 is an enlarged fragmentary plan view of a guide member taken on lines 8—8 of FIG. 7.

DETAILED DESCRIPTION OF PREFERRED EMBODIMENTS

With reference first to FIG. 1, the present invention is arranged for use with a conventional archery bow having a frame portion 10 and bow limbs 12 or other tensioning means. A bowstring 14 is connected between the limbs, and the bow has the usual hand grip portion 16 and an arrow shelf 18.

A first form of guide is shown in FIGS. 1–6 and comprises a right angle support bracket 22 arranged to be secured to the frame 10 of the bow just above the arrow shelf 18. In a preferred construction, bracket 22 is secured to the bow frame 10 so as to provide a use position substantially at right angles to the bow frame. Bracket 22 includes housing 24 which slidably receives guide member 26. Guide member 26 includes parallel elements or rails 28 which includes a notched portion 30 with rear wall 32. Rails 28 also include projectile guiding grooves 28'. Reinforcing web 34 provides a rigid brace for the forward end of the rails.

A resilient means comprising a resilient tubing 36 is secured to the housing 24 by stud 38 and to guide member 26 by stud 40. The bow and the projectile shooting guide are shown in a pre-draw position while the broken lines indicate a drawn position of the invention. Projectile 42 has vertically extending fins 44 and horizontally extending side fins 46, the latter extending rearwardly from the body of the projectile. The side fins extend rearwardly past the vertical fins to provide a tail section for comfortable gripping by the shooter. Aperture 48 in the tail section of the side fins 46 provide a means to engage a release or other drawing aid of a design to be chosen by the shooter. Bowstring nock 50 engages the bowstring 14.

To operate the projectile shooting guide of this first form, the projectile 42 is loaded into the front of the guide member 26 between the rails 28 in the grooves 28'. The projectile is moved to the rear of the guide member into engagement with the bowstring 14. When a release or drawing aid is employed and engaged to the slots 48, a draw force applied by the user will cause the projectile to engage the bowstring, and in turn, the projectile will engage the rear wall 32 of the guide member. The bowstring does not necessarily directly engage the guide member in this form of the invention, however, it can operatively engage the guide member through the projectile which functions as an intermediary. A rearward draw force on the projectile will cause the projectile, the bowstring and the guide member to move rearwardly in unison to a drawn position. This rearward draw will be resisted by the resilient means or tubing 36 as it is extended or stretched as seen by the broken line position of the tubing. Upon release, the projectile will be driven forward by the bowstring while the tubing simultaneously urges the rearward portion of the guide member forwardly towards its pre-draw position. The rearward portion of the guide member is thus automatically returned to its pre-draw position by the resilient means to provide easy handling of the shooting guide.

Another method of drawing the guide is to grasp the bowstring as with a conventional arrow. The notched portion 30 of the guide member or the projectile tail section may also be grasped along with the bowstring.

Referring to FIGS. 7–8 there is shown another form of the projectile shooting guide. Bracket 52 is secured to the bow frame 10 by adjusting slot 54 and bolt 56. The bracket supports guide member 58 which includes barrel 60 and 62, resilient means or resilient tube 64, ribbed portion 66, rearward portion 68 and rearwardly projecting extension 70. This embodiment is shown in a pre-draw position with a drawn position indicated by broken lines. Barrel 60 is a rigid tubular structure and is threaded to receive a second section 62 which is also threaded. The resilient tube 64 is connected to the second section 62 and includes the ribbed portion 66 which provides improved stretching ability to the tube. The rigid tubular structure 68 is connected to the rearward end of the tube 64 and includes a bowstring receiving means or bore 72 and the extension 70 includes a slot 74 for engaging a release or drawing aid.

The second section 62 is designed to provide an easy means to interchange different tensions and sizes of tubes. The tube and the second section can be joined at the factory and sold as a unit so that the user need only to unscrew the second section from the barrel 60 to install a new tube. The slot 74 on the extension 70 of the tubular structure 68 provides the user with the option of using a release or drawing aid or simply grasping the bowstring and the tubular structure 68 to draw the shooting guide.

To operate the shooting guide of this form of the invention a projectile is loaded into the front of the barrel 60 and moved to the rear of the tube to the tubular structure 68. A draw force is applied to the guide member either by use of the slot 74 or by grasping the bowstring and the tubular structure. The rearward draw force will stretch the resilient tube portion of the guide member, such stretching being aided by the ribbed portion 66. When the shooting guide is shot the projectile is propelled by the bowstring and also by the resilient tube 64. This provides good projectile velocity. The bowstring and the tube also provide a guiding influence on the projectile for accurate shooting. Furthermore, when the guide is drawn and released the resilient tube and the bowstring simultaneously urge the tubular structure 68 forwardly towards its pre-draw position.

The two forms of the invention present two different types of resilient means to urge the rearward portion of the guide member forward when the guide is shot, however, other forms of resilient means may be employed to accomplish the same function without departing from the scope of the present invention. Such resilient means include a spring loaded pinion positioned on the bracket 22 and a rack on the guide member 26 or a spring loaded spool on the bracket 22 with a cord extending from the spool to the guide member 26.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. For use with a bow of the type having a bowstring and a tensioning means connected to the bowstring, a projectile shooting guide comprising (a) a support for use on a bow, (b) an elongated guide member for support on a bow by said support, (c) said guide member including forward and rearward portions and when in an operative position said rearward portion extends rearwardly from said support, (d) said rearward portion including a pre-draw position and a drawn positon, (e) means on said rearward portion of said guide member for operatively engaging a bowstring during a rearward drawing movement of said rearward portion, (f) resilient means on said shooting guide operatively connected to said rearward portion so that when said rearward portion is drawn rearwardly from its pre-draw position to its drawn position and then released said resilient means will urge said rearward portion forwardly towards its pre-draw position.

2. The projectile shooting guide of claim 1 wherein said resilient means is connected to said support and to said guide member.

3. The projectile shooting guide of claim 1 wherein said resilient means is longitudinal and is connected to said support and said rearward portion of said guide member.

4. The projectile shooting guide of claim 1 wherein said guide member is slidably engaged to said support, said resilient means being connected to said support and said guide member so that when said guide member is drawn rearwardly and then released, said resilient means will cause a forward sliding movement of said guide member.

5. The projectile shooting guide of claim 1 wherein said rearward portion of said guide member includes a rearwardly projecting extension for receiving a draw force during drawing movements of said guide member.

6. The projectile shooting guide of claim 1 wherein said resilient means comprises a resilient tube connected between said forward and rearward portions of said guide member.

7. The projectile shooting guide of claim 6 wherein said rearward portion of said guide member comprises a rigid tubular structure for receiving a bowstring.

8. The projectile shooting guide of claim 1 wherein said forward portion of said guide member includes rearwardly extending first and second sections, said second section being detachably joined to said first section and said resilient means being connected between said second section and said rearward portion of said guide member.

* * * * *